US005304231A

United States Patent [19]

Kato et al.

[11] Patent Number: 5,304,231

[45] Date of Patent: Apr. 19, 1994

[54] METHOD OF REFINING OF HIGH PURITY STEEL

[75] Inventors: Yoshiei Kato; Tadasu Kirihara; Seiji Taguchi; Tetsuya Fujii, all of Chiba; Shigeru Omiya; Masahito Suito, both of Kurashiki, all of Japan

[73] Assignee: Kawasaki Steel Corporation, Japan

[21] Appl. No.: 993,388

[22] Filed: Dec. 18, 1992

[30] Foreign Application Priority Data

| | | | |
|---|---|---|---|
| Dec. 24, 1991 | [JP] | Japan | 3-340674 |
| Feb. 4, 1992 | [JP] | Japan | 4-019065 |
| Feb. 19, 1992 | [JP] | Japan | 4-031863 |
| Feb. 26, 1992 | [JP] | Japan | 4-039454 |
| Apr. 14, 1992 | [JP] | Japan | 4-094175 |
| Apr. 14, 1992 | [JP] | Japan | 4-094176 |
| Jun. 12, 1992 | [JP] | Japan | 4-153450 |

[51] Int. Cl.[5] ..... C21C 7/02

[52] U.S. Cl. ..... 75/528; 75/510; 75/512

[58] Field of Search ..... 75/510-512, 75/508

[56] References Cited

U.S. PATENT DOCUMENTS 4,944,798 7/1990 Ototani ..... 75/508

FOREIGN PATENT DOCUMENTS 58-9914 1/1983 Japan .
63-114918 5/1988 Japan .

*Primary Examiner*—Peter D. Rosenberg
*Attorney, Agent, or Firm*—Austin R. Miller

[57] ABSTRACT

Disclosed is a method of refining of a high purity steel capable of effectively lowering impurities in molten steel into respective ultra-low ranges. In secondary refining for molten steel after a molten iron prerefining process and a converting process, a reducing agent and a flux are added on the bath surface within a ladle containing the molten steel decarburized in a converter so that the composition of slag on the bath surface is adjusted in such a manner that the total concentration of FeO and MnO becomes 5 wt % or less, and subsequently, impurities in the molten steel are effectively lowered into respective ultra-low ranges using a RH vacuum degassing unit.

12 Claims, 10 Drawing Sheets

METHOD OF REFINING OF HIGH PURITY STEEL

BACKGROUND OF THE INVENTION

1. Field of the Invention

The present invention relates to secondary refining of molten steel, and particularly, to a method of effectively lowering impurities (sulphur, oxygen, nitrogen and carbon) in molten steel to ultra-low ranges using a RH vacuum degassing unit.

2. Description of the Prior Technology

In secondary refining of molten steel, there has been known a method of supplying a flux in a vacuum vessel of a RH vacuum degassing unit for refining under desulphurization, wherein the flux freely falls on the bath surface within the vacuum vessel. Accordingly, for improving reaction rate, the flux in the form of fine powder must be used. This brings about a large disadvantage that the added flux is sucked through the exhaust system before reaching the bath surface of the molten steel. To cope with the disadvantage of using the fine powder flux, there has been proposed a method of using a massive flux; however, use of a massive flux degrades the reaction efficiency.

Also, there has been proposed a method of promoting the reaction while circulating both the molten steel and the flux by injecting a desulphurizing flux into the molten steel directly under a riser using the so-called immersion lance in the RH vacuum degassing unit disclosed in "Material and Process"; Vol 1. 1, p. 1189 (1988). This known technology, however, has disadvantages in that the immersion lance is short in its service life and is difficult in its management, and further, it is difficult to accurately guide both the injected gas and the flux in the riser and hence to manage the operation.

Further, there has been known a desulphurizing refining technology such as that disclosed in Japanese Patent Laid-open No. sho 63-114918. In this technology, a nozzle is provided on the inner wall of a vacuum vessel of a RH vacuum degassing unit in such a manner as to be inclined at 30°-50° with respect to the horizontal direction, and the desulphurization is performed by injecting 1.7–4.0 kg/t of a flux to the steel bath surface within the vessel. This known technology, however, is disadvantageous in that, since the flux is charged in the direction inclined to the steel bath surface, the catching efficiency of the flux to the molten steel becomes poor and the effective desulphurization is obstructed by the influence of the oxidizing potential of the slag on the steel bath.

Also, there has been such a technology as disclosed in Japanese Patent Laid-open No. sho 53-92320, wherein molten steel is secondarily refined by injecting a powder flux on the steel bath within a RH vacuum vessel. However, this known technology is intended to lower the oxygen concentration in the molten steel, and does not refer to the composition of the slag in a ladle which is extremely important in the desulphurizing treatment. Therefore, it is entirely obscure whether or not the above technology is effective in a desulphurizing treatment which is the subject of the present invention.

Further, Japanese Patent Laid-open No. sho 58-9914 discloses a VOD process, wherein the desulphurization is performed by injecting a powder flux together with a carrier gas on the steel bath surface under the reduced pressure using a top-injecting lance. However, this known technology does not teach how the desulphurizing reaction is effected by oxidizing slag (ladle slag), which inevitably flows out upon tapping the molten steel from the primary refining furnace such as a converter to a ladle. Therefore, it is doubtful whether the above technology may be applicable for desulphurizing treatment in a RH vacuum degassing unit.

On the other hand, the melting of ultra-low carbon steel is commonly performed by the steps of decarburization and dephosphorization in the converter, and decarburization and deoxidation in a specified carbon concentration using a secondary refining unit such as an RH vacuum degassing unit or a DH unit. In the melting method of this type, it is important to rapidly perform the decarburization and deoxidation to the low concentration range, which is also desirable for improving the quality of the steel and for preventing the surface defects due to non-metallic inclusions.

To meet the above demand, there has been proposed technologies of effectively performing deoxidation. For example, "Iron and Steel"; No. 11, Vol. 76, pp. 1932–1939 discloses a technology of preventing re-oxidation of the steel bath due to oxides (iron oxide or manganese oxide) in the converter slag floating on the steel bath in the ladle through reduction of the converter slag. However, in this technology, it is impossible to rapidly measure the amount and the composition of the converter slag floating on the steel bath in the ladle, and accordingly, the reduction is made unstable. For example, when a reducing agent is excessively charged, it reacts with the dissolved oxygen in the molten steel, which brings about the lack of the oxygen amount required for decarburization, or which causes the rephosphorization accompanied with the slag reducing action.

Further, it has been pointed out that the essential decarburization is occasionally stagnated, particularly, in the ultra-low carbon range (for example, as disclosed in "Material and Process"; No. 1, Vol. 1. 3, pp. 168 to 171).

As described above, in the conventional technologies, it is not considered how to control the composition of the primary refining slag (ladle slag) discharged from the converter and the composition of the secondary refining slag produced in the ladle or in the vacuum vessel of the RH vacuum degassing unit, which makes it impossible to perform the effective desulphurization and deoxidation.

For example, the above conventional technologies disclosed in Japanese Patent Laid-open Nos. sho 53-92320 and sho 63-114918 disclose the injection of the desulphurizing and deoxidizing flux; however, they do not refer to the composition of the slag in the ladle at all. On the other hand, in the technology proposed in Japanese Patent Laid-open No. sho 58-9914, there appears the description on such a slag composition. The description, however, is made not on the operation of the RH vacuum degassing unit, but on the VOD process in which the slag is strongly stirred together with the steel bath. Further, the proposal relates to the technology of adjusting the basicity of the slag, and thus is not applicable for the RH vacuum degassing treatment.

Also, in addition to the problems of the conventional technologies, the melting of ultra-low sulphur steel has generally the following problem: namely, in the case of performing the desulphurization up to the ultra-low sulphur concentration region, it is necessary to increase the injected amount and the injecting time of the powder flux, and accordingly, the temperature drop due to the powder flux must be compensated by increasing the temperature of the molten steel. However, if the furnace tapping temperature is increased, the life of the refractories in the converter is deteriorated. Needless to say, a method of performing desulphurization while compensating the temperature in the RH vacuum degassing treatment has been sought; but it has not been established as yet.

Further, in the case that the desulphurization is performed by injecting a powder flux on the surface of the molten steel in the RH vacuum degassing unit, it is desirable that the powder is circulated between the vacuum vessel and the ladle together with the flow of the molten steel and is finally caught in the ladle. The powder, however, is commonly in the state of floating on the steel bath surface within the vacuum vessel and is not circulated. Conventional technologies have not solved this problem as yet.

SUMMARY OF THE INVENTION

A primary object of the present invention is to solve the disadvantages of the conventional technologies and to establish a technology for refining ultra-low sulphur and oxygen steel by effectively performing desulphurization and deoxidation for a short time without causing any contamination of molten steel.

An another object of the present invention is to solve the disadvantages of the conventional technologies in refining of ultra-low carbon steel, which obstruct, the ultra-decarburization due to the stagnated decarburization in the ultra-low carbon concentration region and obstruct high purification.

Namely, the present invention is intended to effectively realize the ultra-decarburization and the melting of the high purity steel with compatibility.

The above objects are accomplished in the present invention by providing a method of melting an ultra-low carbon steel comprising the steps of: adding a reducing agent and a desulphurizing and deoxidizing flux on the bath surface in a ladle containing the decarburized molten steel to adjust the composition of slag formed on the bath surface; and effectively lowering impurities (sulphur, oxygen, nitrogen and carbon) in the molten steel to respective ultra-low ranges using a RH vacuum degassing unit.

More specifically, according to the present invention, there is provided a method of refining a high purity steel comprising: a prerefining process of suppressing the contents of P and S contained in molten iron tapped from a blast furnace to 0.05 wt % or less and 0.01 wt % or less, respectively; a process of decarburizing the molten iron after the prerefining process in a converter in such a manner that the carbon content is within the range of 0.02–0.1 wt %; a process of adding a reducing agent and a flux on the bath surface of a ladle containing a molten steel after the decarburizing process, thereby adjusting the composition of slag formed on the bath surface in such a manner that the total concentration of FeO and MnO becomes 5 wt % or less; and a process of injecting an oxidizing gas on the bath surface of the molten steel introduced from the ladle to a vacuum vessel of a RH vacuum degassing unit, thereby adjusting the oxygen concentration and the temperature of the molten steel, injecting a powder containing hydrogen for adjusting the carbon concentration of the molten steel in a specified range, and adding a deoxidizing agent within the vacuum vessel for deoxidizing the molten steel.

Further, according to the present invention, there is provided a method of refining a high purity steel comprising a process of desulphurizing molten steel in a ladle using an RH vacuum degassing unit including a top-injecting lancer, wherein the T·Fe concentration of slag existing on the surface of the molten steel within the ladle is specified to be 10% or less; and a powder flux containing CaO as a main component and 5–40 wt % of $CaF_2$ and/or $Al_2O_3$ is vertically injected on the surface of the molten steel circulating within a vacuum vessel together with a carrier gas at a flow rate of 10 m/sec or more from the top-injecting lancer in an amount specified by the following equation;

$$\omega/\sigma \geqq 0.015A$$

wherein $\omega$ is the weight of the powder mainly containing CaO (Kg), $\sigma$ is the density ($kg/m^3$) of the powder mainly containing CaO, A is the sectional area ($m^2$) of the ladle at the position of the surface of the molten steel, and the value of 0.015 is a coefficient equivalent to the thickness of a flux layer.

DESCRIPTION OF THE PREFERRED EMBODIMENTS

Figure 1:
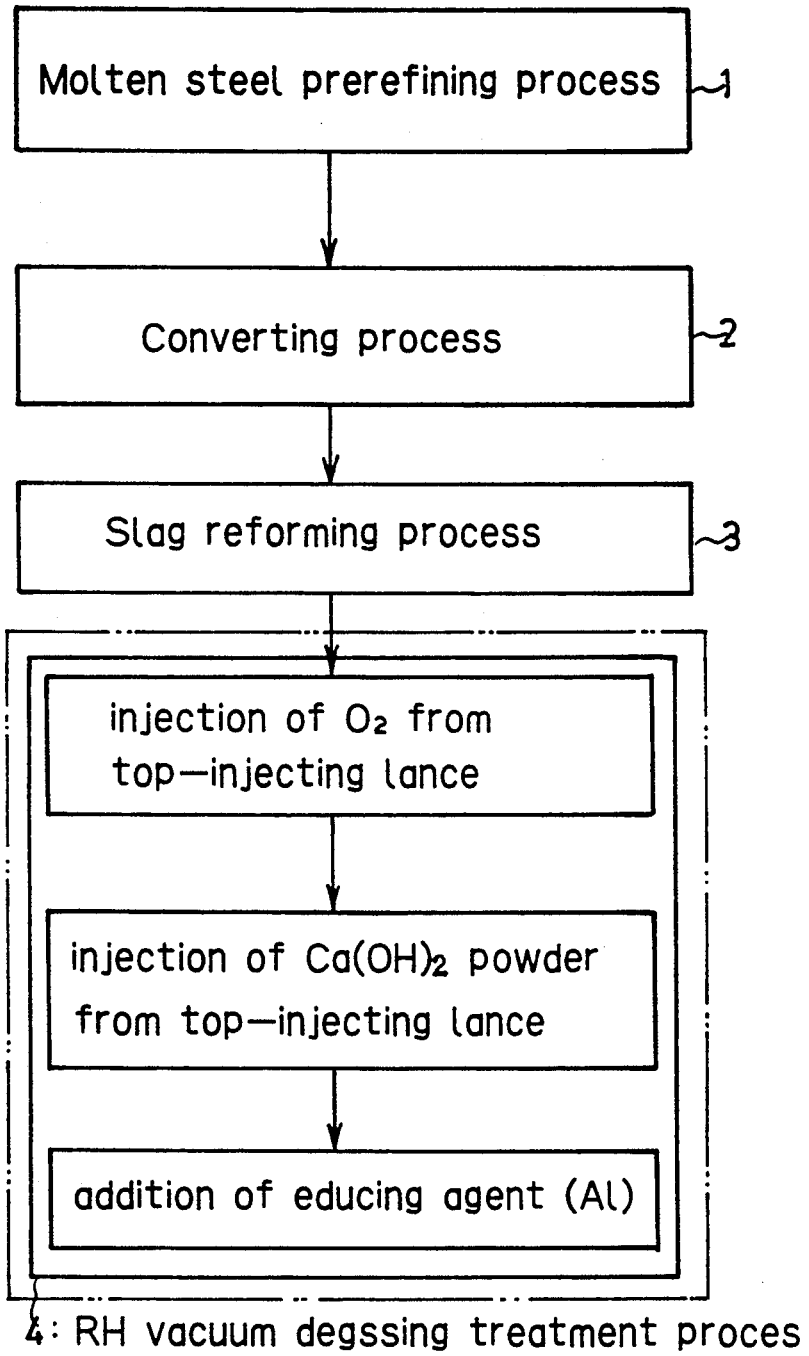
FIG. 1 is a flow chart showing an embodiment of the present invention.

Hereinafter, the present invention will be described in detail with reference to the flow chart of the embodiment as shown in FIG. 1.

(1) Molten Iron Prerefining Process

First, as the prerefining process, it is essential to apply dephosphorization and desulphurization to molten iron tapped from the blast furnace. Namely, by this prerefining process, the unit requirement of supplementary raw material such as CaO can be reduced on the whole melting process. Further, by this prerefining process, $P_2O_5$ in the slag produced by converter blowing may be reduced, thereby eliminating the fear of causing rephosphorization into the molten steel during reduction of $P_2O_5$ in the secondary refining process such as slag reforming and RH vacuum degassing treatment.

(2) Converting Process

In the converter, decarburization is mainly performed. Here, the carbon concentration at blowdown is specified to be 0.02 to 0.1%. When the carbon concentration is less than 0.02%, there arise the following inconveniences: namely, the concentration of iron oxide in slag becomes excessively higher, which exerts adverse effect on the converter refractories; the slag reforming becomes unstable; and, even when CaO or the like is injected from a top-injecting lance in the next RH vacuum degassing treatment, the slag-making between CaO and the slag component such as FeO is readily progressed thereby causing re-oxidation due to the slag, which obstructs the effective progress of the deoxidation. On the other hand, when the carbon concentration is more than 0.1%, the oxygen concentration under decarburization in the next RH vacuum degassing treatment is excessively lowered, which makes it impossible to achieve the rapid decarburization. In addition, in decarburization up to the low carbon level, there secondarily occurs dephosphorization in only a little degree.

(3) Slag Reforming Process

Subsequently, the molten steel after decarburization is tapped in a ladle, and the slag reforming is performed therein. Here, it is essential to adjust the slag component to be $(FeO+MnO) \leqq 5\%$ for preventing re-oxidation from the slag.

Figure 2:
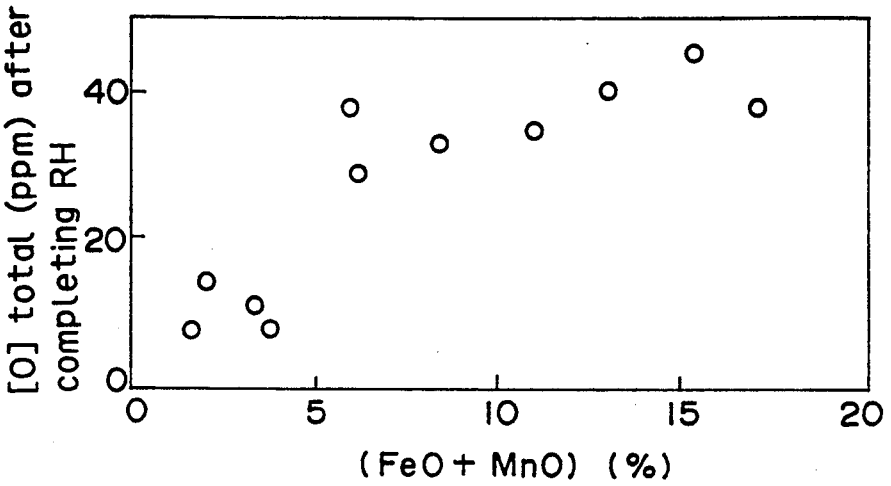
FIG. 2 is a graph showing a relationship between (FeO+MnO) and the total amount of oxygen in steel after RH treatment.

FIG. 2 shows a relationship between the total concentration of FeO and MnO and the oxygen concentration after RH vacuum degassing treatment. As is apparent from this figure, when the total concentration of FeO and MnO is more than 5%, the oxygen concentration after RH vacuum degassing treatment is rapidly increased. The reason for this is that the slag-making between FeO and MnO in the slag and the powder flux containing 50% or more of CaO is rapidly progressed, which obstructs the shielding effect by the flux for the slag-metal interface, thereby progressing re-oxidation.

(4) RH Vacuum Degassing Treatment Process

In the RH vacuum degassing treatment process, the above molten steel is adjusted in specified concentrations of carbon and oxygen. Namely, oxygen or oxidizing gas containing oxygen is injected on the steel bath surface within a vacuum vessel of an RH vacuum degassing unit from a top-injecting lance disposed to the vacuum vessel according to the carbon concentration and the dissolved oxygen obtained in the above processes, and further, the temperature of the molten steel. Here, in lack of the dissolved oxygen concentration, the injected oxygen becomes the oxygen source in the steel and contributes to increase the decarburizing rate. Also, a part of oxygen burns CO gas produced by decarburization to convert it into $CO_2$, and transmits the burning heat thereof to the molten steel. By this injection of the oxidizing gas, it is possible to control the oxygen concentration and the treating temperature of the molten steel to be subjected to the RH vacuum degassing treatment, and hence to eliminate the severe management of the component and the temperature required in the previous converting and slag reforming processes.

Further, for decarburization up to the ultra-low carbon range, powder containing hydrogen such as $Ca(OH)_2$, $Mg(OH)_2$, alum or the like is injected on the steel bath surface within the vacuum vessel from the above top-injecting lancer. For example, in the case of injecting $Ca(OH)_2$, hydrogen atoms H in the steel produced by the reaction of $Ca(OH)_2 \rightarrow CaO + 2\underline{H} + O$ is converted to hydrogen molecules ($2\underline{H} \rightarrow H_2$) in the vicinity of the steel bath surface. At this time, the reaction interface area is simultaneously increased, which promotes the decarburizing reaction of $C+O \rightarrow CO$. Accordingly, the stagnated decarburization generated in the ultra-low carbon range is eliminated, and therefore, the carbon concentration is rapidly lowered up to the limited value to be refined.

The molten steel is thus adjusted in a specified ultra-low carbon concentration, and subsequently deoxidized by the addition of a reducing agent such as Al in the vacuum vessel. The molten steel is further adjusted in its composition. Thus the ultra-low carbon steel of the desired composition is obtained.

Next, there will be described another RH treatment process with reference to FIG. 3. First, the slag composition is adjusted on tapping of the molten steel from the converter or in a ladle 10 in which the molten steel is tapped. After that, an RH vacuum degassing unit is mounted to the ladle 10, and oxygen or oxidizing gas containing oxygen is injected on the steel bath surface within a vacuum vessel 18 of the RH vacuum degassing unit form a top-injecting lance 20 disposed to the vacuum vessel 18 at least for a portion of the RH vacuum degassing treatment. After completing the RH vacuum degassing treatment, Al is added, and subsequently, a powder flux 22 containing 50% or more of CaO is injected on the steel bath surface in an amount of 3 kg per lt of the molten steel from the above top-injecting lance 20.

In the above treatment, by injecting the oxidizing gas on the steel bath surface within the vacuum vessel from the top-injecting lance, it is possible to increase the temperature of the molten steel, and hence to realize the injection of a large amount of the flux in the RH vacuum degassing treatment without remarkably decreasing the temperature of the molten steel before being tapped to the ladle. This flux has a function to promote the floatation of non-metallic inclusions in the molten steel, thereby making it possible to refine the ultra-low carbon steel with high purity.

The reason why the powder flux containing 50% or more of CaO is injected in an amount of 3 kg or more per lt of the molten steel lies in perfectly shielding the slag-metal interface by the flux. When the injected amount of the flux per lt of the molten steel is less than 3 kg, there arises such an inconvenience that the oxygen concentration after the RH vacuum degassing treatment is not lowered.

Further, since the oxidizing gas or the flux is injected from the top-injecting lance, the need of feeding a purge gas is eliminated when the injection is not performed, differently from the case of using an immersion lance. Thus, it is possible to suppress the temperature drop in the RH vacuum degassing treatment to a minimum.

Figure 7:
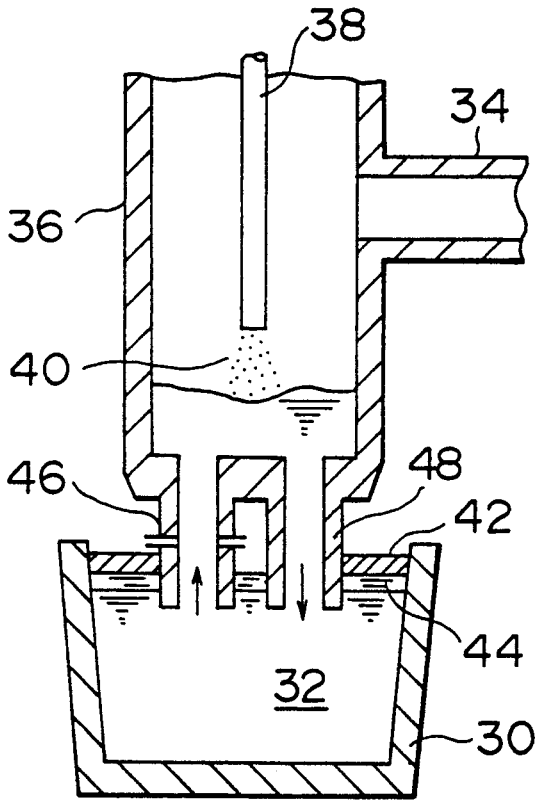
FIG. 7 is a vertical sectional view of an RH degassing treatment unit.

With reference to FIG. 7, there will be described a technology of effectively performing desulphurization under low oxidizing potential by injecting the powder mainly containing CaO in a required amount according to the sectional area of the ladle on the steel bath surface within the RH vacuum vessel from the top-injecting lance.

As shown in FIG. 7, the RH vacuum degassing treatment is performed as follows: Two immersion tubes 46 and 48 provided on the underside of a vacuum vessel 36 are immersed in a molten steel 32 within a ladle 30. The molten steel 32 in the ladle 30 is lift-pumped within the vacuum vessel 36 while performing the exhaust through an exhaust port 34 provided on the upper portion of the vacuum vessel 36, and simultaneously argon gas is injected to the above lift-pumping immersion tube 46. Thus, while the molten steel 32 is circulated between the ladle 30 and the vacuum vessel 36 by the above lift-pumping action, the degassing treatment is performed.

According to the present invention, in the above RH treatment, the top-injecting lance 38 is descended within the vacuum vessel 36 and is made to face to the molten steel 32. Thus, from the leading edge of the top-injection lance 38, the flux 40 mainly containing CaO is injected on the molten steel surface together with a carrier gas such as argon at a gas flow rate of 10 m/s or more. The reason why the gas flow rate of the carrier gas is 10 m/s or more is as follows; namely, for the flow rate less than 10 m/s, the flux 40 is not effectively permeated into the molten steel 32; and for the flow rate more than 10 m/s, even a fine powder flux (for example, under 325 mesh) is not sucked to the vacuum exhaust port 34 and is effectively permeated in the molten steel 32.

Incidentally, the effective desulphurization cannot be achieved merely by injecting the flux 40 in a specified amount. It is essential to inject the flux 40 in the specified amount according to the sectional area of the ladle. Namely, the flux 40 injected on the molten steel 32 and the ladle slag 42 having a high oxidizing potential must perfectly shield the molten steel 32 from the ladle slag 42 for reducing the oxidizing potential at the reaction interface.

Accordingly, even with the same amount of the molten steel, if the sectional area of the ladle is smaller, the flux amount may be reduced; and conversely, if being larger, the flux amount must be increased.

The present inventors have earnestly studied, and found the fact that desulphurization is progressed to the ultra-low sulphur level when the following relationship is satisfied between the flux amount and the sectional area of the ladle:

$$\omega/\rho \geqq 0.015A$$

wherein $\omega$ is an amount (kg) of powder mainly containing CaO, $\rho$ is a density (kg/cm$^3$) of powder mainly containing CaO, A is a sectional area of a ladle at the position of the molten steel surface, and the value of 0.015 is a coefficient meaning the thickness of the flux.

In addition, as the composition of the ladle slag having a high oxidizing potential, it is preferably within the range of (% T·Fe)$\leqq$10. In the course of the present invention, it has been found the fact that, for the slag composition of (% T·Fe)>10%, the flux does not achieve the perfect shielding effect between the slag and the metal. Here, the content of $CaF_2$ and/or $Al_2O_3$ with respect to the total flux is specified at 5 to 40 wt %. The reason for this lies in improving the desulphurizing ratio due to the promotion of the slag-making for the main component, CaO.

Next, there will be described the case of injecting the powder flux mainly containing CaO in the molten steel in the vacuum vessel of the RH vacuum degassing unit.

The powder flux mainly containing CaO, which is injected in the molten steel within the vacuum vessel of the RH vacuum degassing unit, reacts with sulphur in the molten steel and partially forms CaS. The CaS thus formed flows in the ladle in the state being suspended in the molten steel, and subsequently, it is floated on the bath surface within the ladle, thus progressing the desulphurization. Further, the partially unreacted flux is also floated on the bath surface along the same path. The CaS floated on the bath surface is contaminated in the slag deposited on the bath surface. At this time, when the oxidation degree of the slag is high, that is, (FeO+MnO) % is high, it may be considered that the CaS is decomposed again and [S] is returned into the molten steel, thereby obstructing the progress of the desulphurization. Accordingly, the adjustment of the slag composition is effective to improve the desulphurizing efficiency.

Figure 10:
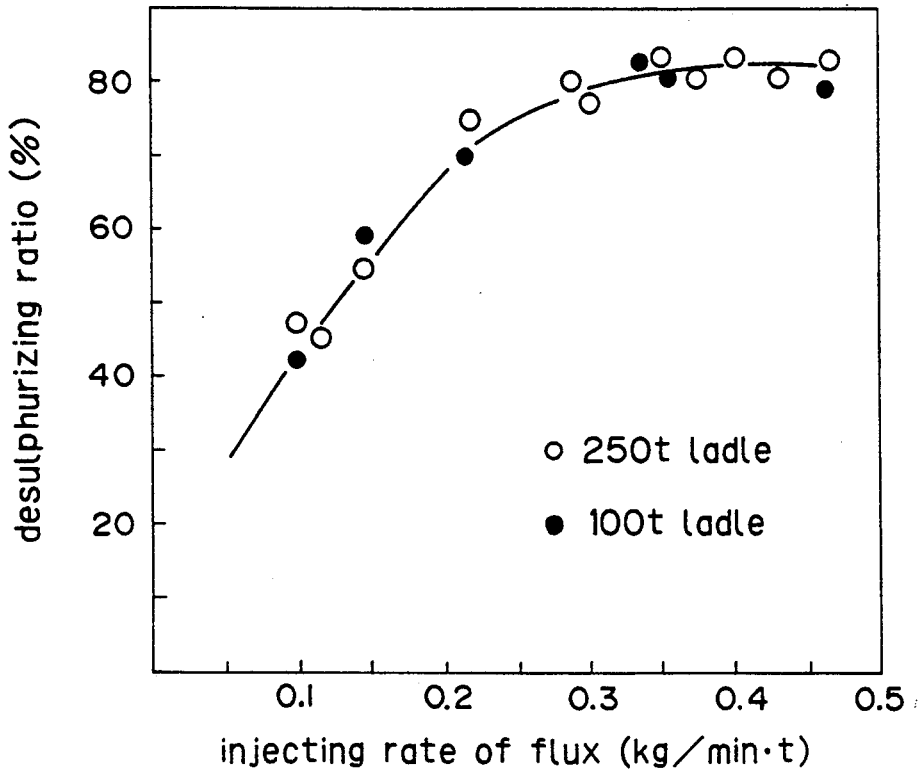
FIG. 10 is a graph showing a relationship between the injecting flow rate of a powder flux and the desulphurizing ratio.

Also, in the above process, when the used amount of the powder flux is constant, the flow rate of the powder flux injected on the molten steel within the vacuum vessel may be enlarged for increasing the desulphurizing efficiency. The present inventors have examined the desulphurizing ratio in changing the injecting rate of the powder flux (CaO+20% $CaF_2$:4 kg/t) to the molten steel introduced in the vacuum vessel of the RH vacuum degassing unit. As a result, as shown in FIG. 10, it was revealed that the injecting rate is preferably within the range of 0.2 kg/min or more per 1 t of the molten steel.

The reason why the injecting rate of the powder flux exerts the influence on the desulphurizing ratio is as follows: Namely, the flux suspended in the molten steel within the vacuum vessel is returned in the ladle and floated on the bath surface. The floated flux is supposed to be deposited in a layer structure, and the growing rate of the deposited layer in the thickness direction is proportional to the flow rate of the injected powder flux. Also, the deposited layer reacts with the slag on the bath surface, and FeO and MnO in the slag is diffused in the flux, so that the flux is liable to be integrated with the slag. Accordingly, in the case that the growing rate of the flux deposited layer is large, the tendency to be integrated with the oxidizing slag containing FeO and MnO exceeds the growing rate of the flux deposited layer, so that the oxidation degree of the floated flux is increased and CaS in the flux is decomposed in the oxidizing environment. Thus, [S] is returned again in the molten steel, thereby reducing the desulphurizing ratio.

On the other hand, in the case that the growing rate of the flux deposited layer is large enough to exceed the integrating tendency with the slag, FeO and MnO is restrictedly diffused and permeated to a part of the flux layer, as a result of which the flux composition in the vicinity of the interface in contact with the molten steel is not changed. Accordingly, CaS is not decomposed and the desulphurizing ratio is not reduced. In addition, the suitable range of the injection rate of the powder flux is considered to be changed according to the size of the equipment, for example, the sectional area of the ladle. However, as shown in FIG. 10, the substantial difference does not exist between the ladles of 100 t and 250 t. Consequently, in the operation on the commercial scale, the powder flux may be injected at an injecting rate of 0.2 kg/min or more per 1 t of the molten steel.

Next, in the RH degassing treatment, with reference to FIGS. 12 and 13, there will be described a process of adding aluminum and a reducing agent containing aluminum in the molten steel while injecting oxygen or oxidizing gas on the molten steel. First, in starting the RH degassing treatment, the temperature of the molten steel is increased by adding aluminum or the reducing agent containing aluminum in the molten steel while injecting oxygen or oxidizing gas on the molten steel from a top-injecting lance 78. The above treatment makes it possible to increase the temperature of the molten steel during the RH degassing treatment without increasing the furnace tapping temperature, and hence to enhance the desulphurizing efficiency. By the addition of Al in the molten steel together with oxygen, the temperature drop caused by injection of a flux 80 from the top-injecting lancer 78 is able to be compensated. In addition, the added amount of Al together with oxygen is specified as the following chemically correct mixture ratio:

$$2Al+3/2O_2 \rightarrow Al_2O_3$$

Thus, by increasing the temperature of the molten steel by means of the above oxygen injection and the addition of Al on the steel bath surface within the vacuum vessel, prior to injection of the powder flux such as CaO for the RH vacuum degassing treatment and desulphurization, the RH vacuum degassing treatment is not exerted by the influence of the previous process (converting), and the desulphurizing rate is promoted.

Also, as another means, there is added a process of reducing the steel bath depth within the vacuum vessel during the above injection of CaO. As a result of a water model experiment made by the present inventors, in the case that the powder flux (average particle size: 0.5 mm $\phi$) having a specific gravity smaller than water is injected on the steel bath surface, the smaller the bath depth, the larger the ratio of the flux being circulated and contaminated in the molten steel within the ladle.

Figure 13:
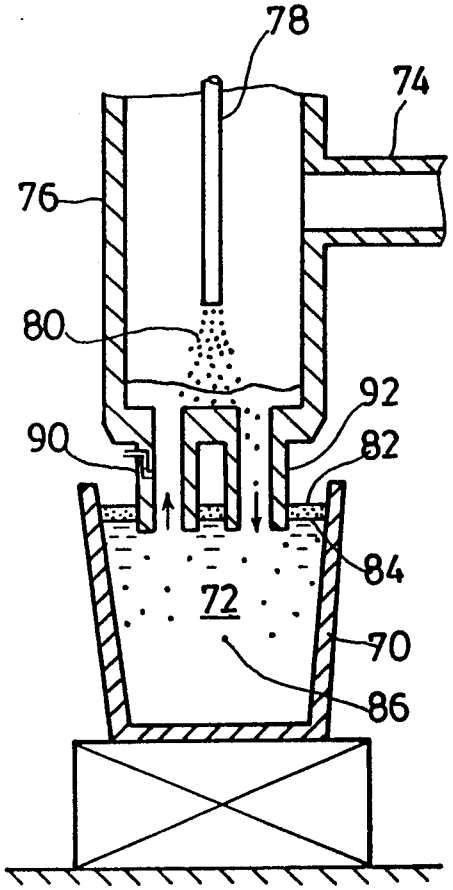
FIG. 13 is a sectional view showing the powder included state in the case of changing the bath depth.
Figure 12:
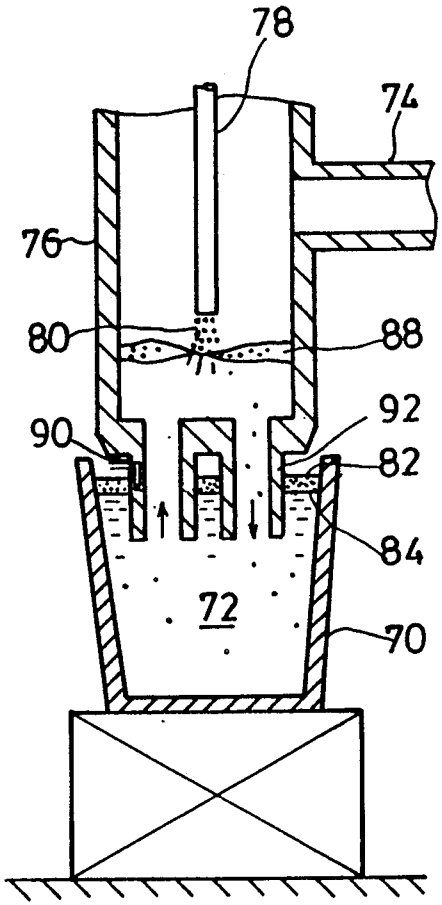
FIG. 12 is a sectional view showing the powder included state in the case of changing the bath depth.

By the reduction in the bath depth, as shown in FIG. 13, CaO powder is also circulated in the ladle 70 without remaining in the vacuum vessel, so that the effective desulphurization may be increased as compared with the case, as shown in FIG. 12, that the bath depth is larger.

Commonly, between CaO powder and [S] in the steel, a reaction of $CaO+S \rightarrow CaS+O$ occurs. Accordingly, by making longer the time for which the injected CaO powder is circulated together with the molten steel to be thus contacted therewith, it is possible to increase the reaction efficiency. To the contrary, when the injected CaO powder remains on the steel bath surface 88 within the vacuum vessel 76, it seems reasonable that the desulphurizing efficiency is not increased due to the reduced reaction interface area.

Thus, by combining the treatments of: increasing the temperature of the molten steel by means of the addition of oxygen or oxidizing gas and aluminum; reducing the steel bath depth within the vacuum vessel; and injecting CaO from the top-injecting lance, it is possible to remarkably improve the reaction efficiency of CaO. Accordingly, for achieving the sufficient desulphurizing performance, the injected amount of CaO is about 1 kg/t, preferably, more than 1 kg/t.

In addition, the experiment was made under the condition of simultaneously satisfying the above treatments of increasing temperature of the molten steel, reducing the bath depth, and injecting CaO, which gave the result of the further excellent desulphurizing efficiency.

Also, in the course of the research on the further desulphurizing method, the present inventors have found the fact that, even if FeO and MnO in the slag are controlled to be lowered, there occasionally occurs a large variation in the desulphurizing ratio.

Thus, the present inventors have examined the composition of the ladle slag at this time, and found the fact that, the desulphurization is rapidly progressed to the ultra-low sulphur range under the condition that the component ratio among CaO, Al2O3 and SiO2 is specified by the following equation:

$$W_{CaO}/(W_{Al_2O_3}+2.5W_{SiO_2}) \geqq 0.9$$

wherein $W_{CaO}$ is CaO wt % in the slag, $W_{Al_2O_3}$ is $Al_2O_3$ wt % in the slag, and $W_{SiO_2}$ is $SiO_2$ wt % in the slag.

Namely, under the condition that the composition of the ladle slag is out of the above equation, that is, under the undesirable condition, even if the flux injected on the steel bath surface within the vacuum vessel of the RH vacuum degassing unit has a high desulphurizing performance and CaS is generated by the reaction between CaO and [S] in the molten steel, when the flux particles are floated and contacted with the ladle slag, the produced CaS cannot be kept as it is and [S] is released in the molten steel, resulting in the reduced desulphurizing ratio.

As described above, it is important to reform the composition of the ladle slag before performing the RH vacuum degassing treatment.

Namely, during the RH vacuum degassing treatment, the top-injecting lance provided on the upper portion of the vacuum vessel is descended in the vacuum vessel, and the powder flux mainly containing CaO is injected on the molten steel surface together with the carrier gas such as argon gas, to be thus reacted with sulphur in the molten steel. Thus, a part of the injected powder flux becomes CaS, and simultaneously the powder flux is certainly floated on the slag layer deposited on the upper portion of the ladle, thereby promoting the desulphurizing reaction.

The present invention will be more clearly understood with reference to the following examples:

WORKING EXAMPLE 1

The present invention was embodied according to the processes as shown in FIG. 1.

(1) Molten Iron Prerefining Process

The molten iron was tapped in an amount of 300 t from the blast furnace to the torpedo car. Subsequently, a flux was injected on the molten iron from an immersion lance for dephosphorization and desulphurization. At the same time, the slagging-off of the dephosphorizing slag was made. In the above, as the dephosphorizing flux, 25–35 kg/t of iron oxide, 8–15 kg/t of quicklime and 1–2 kg/t of $CaF_2$ were used. Also, as the desulphurizing flux, 6–8 kg/t of (30% CaO+70% $CaCO_3$) was used. In this molten iron prerefining process, phosphor content was lowered from 0.11–0.12% to 0.035–0.05%, and sulphur content was lowered from 0.02–0.03% to 0.005–0.009%.

(2) Converting Process

Subsequently, 300 t of the molten iron thus treated was blown in a top-and-bottom blown converter. The carbon content at the blowdown was 0.02–0.10% and the temperature of the molten steel was 1610°–1630° C. In addition, the flow rate of the top-blowing $O_2$ was 700 $Nm^3$/min, and the flow rate of the bottom-blowing inert gas was 20–30 $Nm^3$/min.

(3) Slag Reforming Process

During tapping the molten steel from the above converter to the ladle, a flux containing CaO as a main component and 40% of Al was added in an amount of 1.3–1.5 kg per 1 t of the molten steel for adjusting the total concentration of FeO and MnO in the slag deposited on the steel bath in the ladle to be 1.3–5.0%. At this time, the oxygen concentration in the molten steel was 100–550 ppm, and the temperature of the molten steel was 1590°–1610° C.

(4) RH Vacuum Degassing Treatment Process

At the time elapsing 2 min. since starting the RH vacuum degassing treatment, a water cooling lance vertically inserted from the top to the bottom of the vacuum vessel was fixed at such a position that the leading edge thereof was apart from the bath surface by 1.5–2.0 m. $O_2$ gas was injected on the steel bath surface at a flow rate of 30–50 $Nm^3$/min from the above lance, so that the $O_2$ concentration after injection was 500–600 ppm and the temperature of the molten steel was 1595°–1610° C.

After that, from the above lance positioned to be apart from the bath surface by 1.5–1.8 m, $Ca(OH)_2$ powder was injected together with a carrier gas of Ar gas (2–3 $Nm^3$/min) at an injecting rate of 30–60 kg/min. Thus, the concentrations of carbon and oxygen were adjusted to be 5–7 ppm and 450–550 ppm, respectively.

Further, a reducing agent of Al was added in an amount of 1.2–1.4 kg/t, and subsequently, the degassing treatment for the molten steel was made for 8–10 min. Thus, the RH degassing treatment was completed.

The composition of the molten steel thus treated was; C: 5–7 ppm, Al: 0.03–0.04%, P: 0.024–0.030%, and S: 0.004–0.008%. Further, the temperature of the molten steel was 1570°–1580° C.

Also, comparative examples were made by the treatments in which part of the above continuous processes was omitted, or by the treatments including the processes out of the present invention. The compositions of the molten steels thus obtained were examined. The results are shown in Table 1 together with those according to this working example.

TABLE 1

| Molten iron dephosphorizing and desulphurizing process | Decarburizing process | Slag reforming process | RH treatment process: Top-injection of $O_2$ | RH treatment process: Top-injection of $Ca(OH)_2$ | Component |
|---|---|---|---|---|---|
| [% P] ≦ 0.05<br>[% S] ≦ 0.01 | 0.02 ≦ [% C] ≦ 0.01 | (FeO + MnO) ≦ 5 (%) | presence | presence | C/5–7 ppm, O/15–23 ppm, P/0.024–0.038%, S/0.004–0.008% |
| [% P] ≦ 0.06<br>[% S] ≦ 0.01 | [% C] = 0.07 | (FeO + MnO) ≦ 4.5 (%) | presence | presence | C/7 ppm, O/20 ppm, P/0.046%, S/0.008% |
| [% P] ≦ 0.041<br>[% S] ≦ 0.013 | [% C] = 0.04 | (FeO + MnO) ≦ 3.5 (%) | presence | presence | C/6 ppm, O/21 ppm, P/0.028%, S/0.011% |
| [% P] ≦ 0.04<br>[% S] ≦ 0.008 | [% C] = 0.01 | (FeO + MnO) ≦ 7.0 (%) | presence | presence | C/7 ppm, O/33 ppm, P/0.024%, S/0.007% |
| [% P] ≦ 0.0037<br>[% S] ≦ 0.006 | [% C] = 0.14 | (FeO + MnO) ≦ 2.1 (%) | presence | presence | C/14 ppm, O/17 ppm, P/0.031%, S/0.005% |
| [% P] ≦ 0.046<br>[% S] ≦ 0.007 | [% C] = 0.08 | (FeO + MnO) ≦ 6.3 (%) | presence | presence | C/7 ppm, O/29 ppm, P/0.029%, S/0.007% |
| [% P] ≦ 0.0036<br>[% S] ≦ 0.006 | [% C] = 0.05 | (FeO + MnO) ≦ 3.8 (%) | absence | presence | C/25 ppm, O/40 ppm, P/0.021%, S/0.005% |
| [% P] ≦ 0.031<br>[% S] ≦ 0.005 | [% C] = 0.06 | (FeO + MnO) ≦ 2.9 (%) | presence | absence | C/29 ppm, O/41 ppm, P/0.028%, S/0.005% |

WORKING EXAMPLE 2

The molten iron was blown in the converter. The carbon content at the blow-down was 0.03–0.05% and the temperature of the molten steel was 1635°–1650° C. The molten steel in an amount of 280 t was tapped to the ladle. A reducing agent containing alumina as a main component and 40% of Al was added to the converter slag flown in the ladle, to thus adjust the total concentration of FeO and MnO in the slag to be 5% or less.

Figure 3:
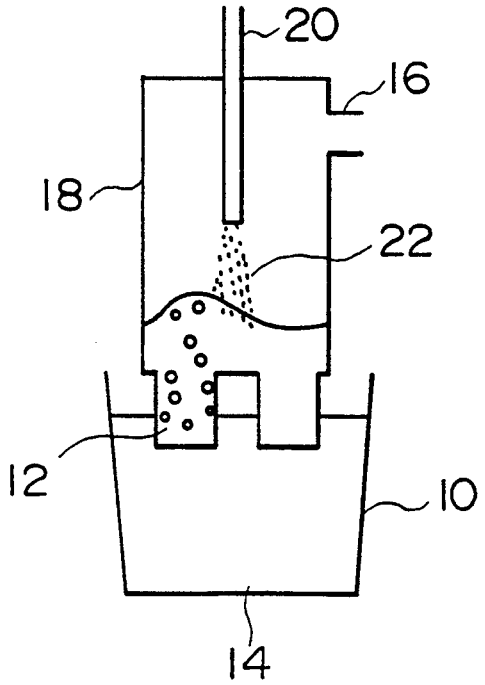
FIG. 3 is a typical view showing a RH treatment unit.

After that, as shown in FIG. 3, an immersion tube 12 of a RH vacuum degassing unit was inserted in a molten steel 14 of a ladle 10, and the molten steel 14 was introduced in a vacuum vessel 18 while performing the exhaust from an exhaust port 16. Subsequently, Ar gas was injected in the molten steel from the immersion tube 12, and thereby the degassing treatment was made by the circulation of the molten steel using the lift-pumping action. At the time elapsing 2 min. since starting the RH vacuum degassing treatment, 120–280 $Nm^3$ of $O_2$ gas was injected at a flow rate of 35 $Nm^3$/min from a top-injecting lancer 20 vertically inserted from the top to the bottom of the vacuum vessel. For the time of 20 min. after starting the RH treatment, decarburization was made, and subsequently, deoxidation was made by the addition of Al to thus adjust the Al concentration in the molten steel to be $50\times10^{-3}$%. After that, CaO powder 22 was supplied together with a carrier gas of Ar gas at an injection speed of 100–150 kg/min from the top-injecting lance 20 further descended. For the time of 3–5 min. after injection of the CaO powder 22, the molten steel was circulated. Thus the RH treatment was completed.

Figure 4:
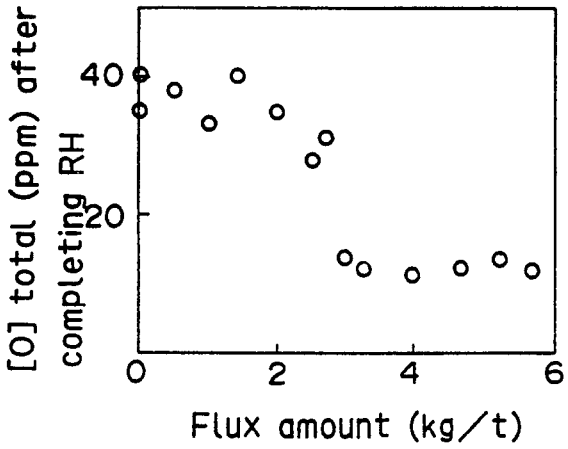
FIG. 4 is a graph showing a relationship between the flux amount and the total amount of oxygen in steel after RH treatment.

FIG. 4 shows a relationship between the supplied amount of the powder flux 22 of CaO and the total oxygen amount in the steel after the RH treatment. As is apparent from this figure, since the oxygen concentration is not lowered for the supplied amount of the CaO powder being less than 3 kg per 1 t of the molten steel, the flux in an amount of 3 kg or more per 1 t of the molten steel is required for stably melting a high purity steel containing the total oxygen in an amount of 15 ppm or less.

Figure 5:
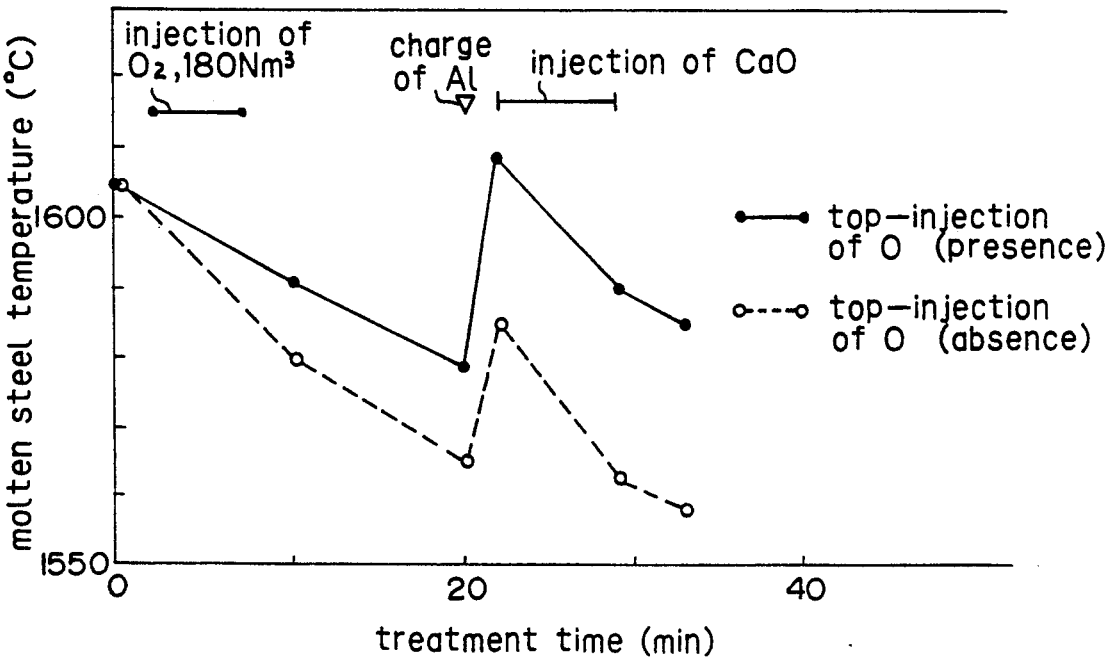
FIG. 5 is a graph showing the effect of oxidizing gas injection exerted on the temperature of molten steel.

Further, by injecting $O_2$ gas from the top-injecting lance during the RH treatment, a large amount of flux could be supplied without remarkably decreasing the temperature of the molten steel before the RH treatment. FIG. 5 shows the change in the temperature of the molten steel during decarburization in the case that 3.3 kg/t of the flux is top-injected after 180 $Nm^3$ of $O_2$ gas is top-injected, or in the case that 2.5 kg/t of the flux is top-injected without the top-injection of the $O_2$ gas. As is apparent from this figure, by top-injecting $O_2$ gas before the injection of the flux, the temperature of the molten steel in the vacuum vessel due to the secondary combustion generated during rimming treatment is increased, thereby making smaller the decreasing rate of the temperature during the treatment. When $O_2$ gas was not injected under the condition that the temperature of the molten steel before the RH treatment is similar to the above, the temperature of the molten steel was lowered, and thus the amount of the flux was reduced.

Figure 6:
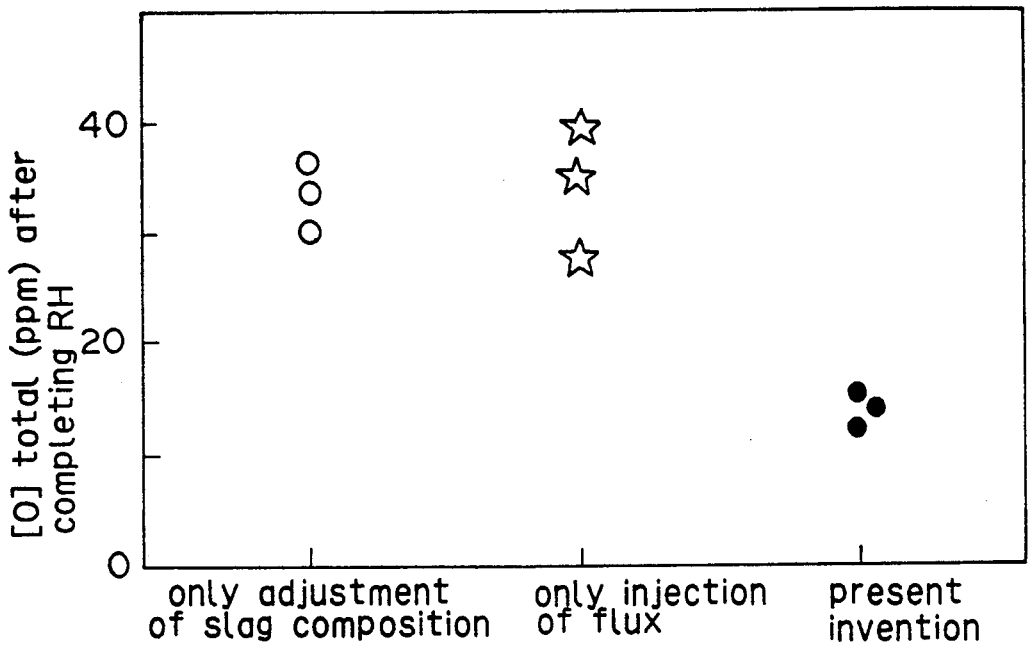
FIG. 6 is a graph showing a relationship between each treatment and the total amount of oxygen in steel after RH treatment.

As compared with the case of adjusting the composition of the ladle slag and of injecting the flux, there were examined two comparative examples including only adjusting the composition of the ladle slag{(FeO+MnO)≦5%}, and only injecting the flux (3 kg/t). In each of the comparative examples, the total oxygen amount in the steel after the RH treatment was obtained. The results are shown in FIG. 6. From this figure, it is revealed that the ultra-low carbon steel with high purity can be obtained only according to the combination of processes of the present invention.

In addition, the powder flux of CaO was used in this working example; however, the powder flux containing at least 50% of CaO sufficiently gives the desired effect, and therefore, it may contain MgO or the like, other than CaO.

WORKING EXAMPLE 3

The molten steel in an amount of 240–300 t was tapped from the converter to the ladle. During tapping, fused slag in an amount of 2500–3500 kg flowed in the ladle.

The slag composition was; CaO: 40–50%, $SiO_2$: 12–18%, T.Fe: 7–11%, and $Al_2O_3$: 15–20%.

The above molten steel was subjected to RH treatment. The treatment time was 20 min. and the vacuum degree was 0.4–0.5 Torr.

As comparative charges, there were performed the methods of: (1) reducing the injected amount of the powder; and (2) adding the powder in the vacuum vessel.

Also, the flow rate of a carrier gas in injecting the powder in the vessel was 3–6 $Nm^3$/min, and the top-blowing lance of single opening type or Laval type was used. Table 2 shows this working example and the comparative example.

Hereinafter, there will be described the working examples and the comparative examples. As is apparent from Table 2, according to the present invention, wherein the flux containing CaO as a main component and 5–40% of $CaF_2$, $Al_2O_3$, or a mixture of $CaF_2$ and $Al_2O_3$ is injected to the molten steel circulating in the RH vacuum vessel so as to satisfy the relationship of $\omega/(\rho \cdot A) \geqq 0.015$, the sulphur concentration easily reaches the level by the ppm of one figure.

On the contrary, as shown in the comparative examples 3-1 to 3-3 comparable with the working example 3-2, in the case of not satisfying the requirement of the present invention, that is, $(\omega/(\rho \cdot A) < 0.015)$, the desulphurization up to the ultra-low sulphur region cannot be achieved irrespective of the amount of the flux. Also, in the comparative example 3-4 comparable with the working example 3-3, that is, in the case that the composition of the synthetic flux does not satisfy the requirement of the present invention, the ultra-low sulphur steel cannot be obtained. Further, in the comparative example 3-5 wherein the flux is added not by injecting, but by top-addition within the vessel through free-falling, the requirement of the present invention is not satisfied, thereby making it impossible to obtain the ultra-low sulphur steel.

TABLE 2

| | Charge of flux | Composition of synthetic flux (%) | Synthetic flux amount, $\omega$ (kg) | Synthetic flux injecting rate (kg/min) | Amount of treated molten steel (t) | Before treatment S (ppm) | Before treatment (T · Fe) (%) | Sectional area of ladle A ($m^2$) | $\omega/\rho \cdot A$ | After treatment S (ppm) |
|---|---|---|---|---|---|---|---|---|---|---|
| Working example 3-1 | Injection in vessel | CaO/80, $CaF_2$/20 | 670 | 100 | 240 | 30 | 7.2 | 10.5 | 0.02 | 5 |
| 3-2 | Injection in vessel | CaO/60, $CaF_2$/40 | 500 | 80 | 270 | 28 | 9.8 | 10.5 | 0.015 | 3 |
| 3-3 | Injection in vessel | CaO/95, $CaF_2$/5 | 1200 | 120 | 240 | 32 | 9.4 | 12.5 | 0.03 | 6 |
| 3-4 | Injection in vessel | CaO/70, $Al_2O_3$/30 $CaF_2$/10 | 630 | 70 | 300 | 38 | 9.5 | 12.5 | 0.015 | 5 |
| 3-5 | Injection in vessel | CaO/60, $Al_2O_3$/40 | 1310 | 110 | 270 | 30 | 8.8 | 15.0 | 0.025 | 6 |
| 3-6 | Injection in vessel | CaO/80, $Al_2O_3$/20 | 760 | 90 | 240 | 35 | 9.0 | 15.0 | 0.015 | 4 |
| Comparative example 3-1 | Injection in vessel | CaO/60, $CaF_2$/40 | 620 | 80 | 240 | 26 | 8.9 | 15.0 | 0.013 | 16 |
| 3-2 | Injection in vessel | CaO/60, $CaF_2$/40 | 400 | 80 | 270 | 25 | 8.1 | 10.5 | 0.012 | 17 |
| 3-3 | Injection in vessel | CaO/70, $Al_2O_3$/20 | 500 | 90 | 270 | 30 | 10.1 | 15.0 | 0.010 | 15 |
| 3-4 | Injection in vessel | CaO/100 | 800 | 100 | 240 | 30 | 9.1 | 12.5 | 0.020 | 21 |
| 3-5 | Top-addition | CaO/60, $CaF_2$/40 | 960 | — | 240 | 28 | 8.5 | 15.0 | 0.02 | 14 |

The composition of the molten steel on tapping was; C: 0.04–0.06%, Si: 0.15–0.25%, Al: 0.03–0.04%, and S: 0.003–0.004.

WORKING EXAMPLE 4

In the molten iron tapped from the blast furnace, the contents of P and S were adjusted to be 0.036–0.048% and 0.002–0.003%, respectively. Subsequently, the molten iron was blown in the top-and-bottom-blown converter, and the molten steel in an amount of about 260 t was tapped in the ladle. During tapping the molten steel in the ladle, FeSi alloy, FeMn alloy and Al were added in the molten steel, to thus adjust the molten steel in the ladle as follows; C: 0.11–0.13%, Mn: 1.2–1.3%, Si: 0.35–0.38%, Al: 0.025–0.053%, S: 0.003–0.004%, and P: 0.021–0.025%. Also, for lowering [%FeO] and [%MnO] in the slag on the steel bath surface within the ladle, the powder flux containing CaO as a main component and 40% of Al was added in an amount of 1.5 kg per 1 t of the molten steel, to thus adjust the total concentration of [%FeO] and [%MnO] to be 5% or less.

Figure 8:
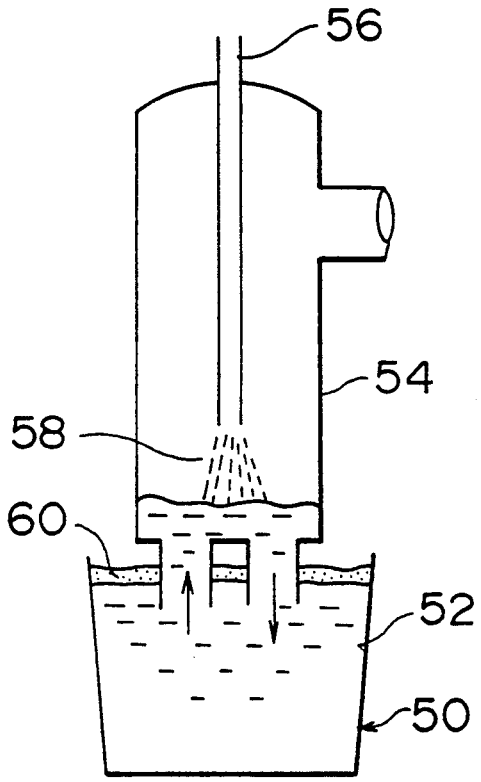
FIG. 8 is a typical view of an RH degassing treatment unit.
Figure 9:
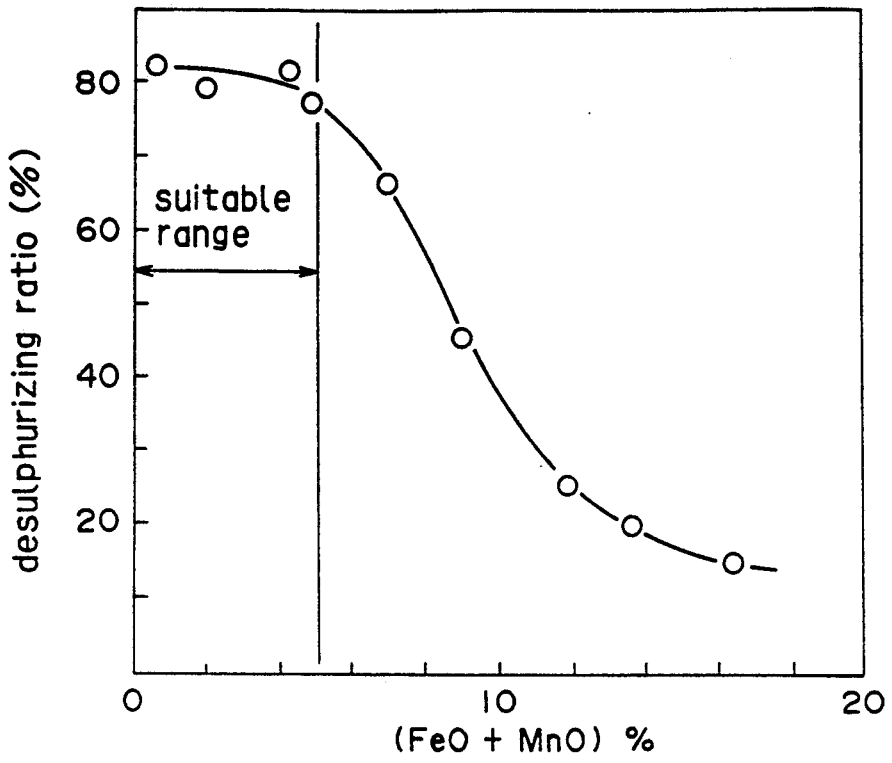
FIG. 9 is a graph showing a relationship between (FeO+MnO) and the desulphurizing ratio.

Next, using an RH degassing unit as shown in FIG. 8, at the time elapsing 2 min. since starting the RH degassing treatment, a water cooled lance vertical inserted from the top to the bottom of the vacuum vessel was fixed at such a position that the leading edge thereof is apart from the bath surface by 1.5–2.0 m. Then, CaO powder (average particle size: 68 μm) containing 20% of CaF2 was injected together with a carrier gas of Ar gas at a flow rate of 0.2–0.5 kg/min per 1 t of the molten steel for 15–25 min. After that, alloys for adjusting the composition of the molten steel were added, and subsequently, the degassing treatment for the molten steel was made for 5–12 min., thus completing the RH degassing treatment.

Figure 11:
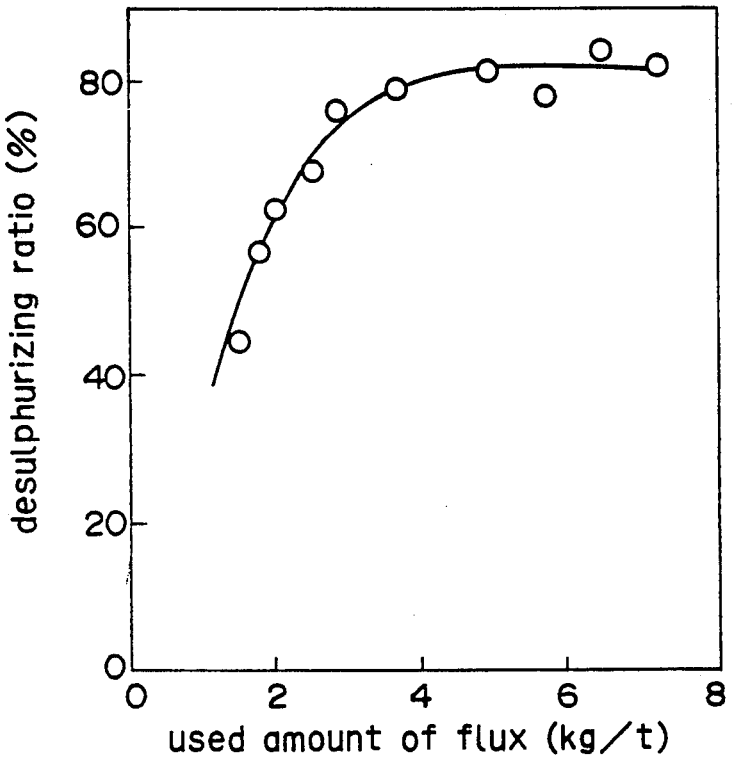
FIG. 11 is a graph showing a relationship between the used amount of a flux and the desulphurizing ratio.

The above treatment was repeated by 10 charges, and the sulphurizing ratio was obtained on the basis of the change in [S] concentration after and before each treatment. FIG. 11 shows the relationship between the above sulphurizing ratio and the used amount of the flux per 1 t of the molten steel. In addition, the sulphurizing ratio was calculated on the basis of the equation of $(1-[\%S]_f/[\%S]_i\times 100)$, wherein $[\%S]_f$ is a sulphur concentration before the treatment, and $[\%S]_i$ is a sulphur concentration after the treatment. As shown in FIG. 11, according to the present invention, the high sulphurizing ratio was obtained. In addition, although the total concentration of FeO and MnO in the slag was lowered by the above treatment, the increased concentration of P in the molten steel was within the allowable range of 0.001–0.002%.

WORKING EXAMPLE 5

The molten steel in an amount of 270–300 t was tapped from the converter to the ladle. The composition of the molten steel was; C: 0.04–0.05 wt %, Si: 0.25–0.35 wt %, Mn: 0.8–1.0 wt %, P: 0.007 wt % or less, Al: 0.02–0.04 wt % and S: 0.002–0.004 wt %.

The powder slag flowed in the ladle was reformed by the addition of a reducing agent containing Al. The composition of the reformed slag was; CaO: 40–50%, $SiO_2$: 10–17%, $Al_2O_3$: 18–23%, and (FeO+MnO): 0.5–5.0%. The amount of the reformed slag was 2500–3500 kg.

After adjustment of the composition of the reformed slag in the ladle described above, the molten steel of the above composition was subjected to RH vacuum degassing treatment. The treatment time was 20–25 min. and the vacuum degree was 0.4–1.0 Torr. Also, the injecting rate of the oxygen from the top-injecting lance 6 was 30–60 $Nm^3$/min. In injecting CaO powder, a carrier gas of Ar gas was supplied at the injecting rate of 3–5 $Nm^3$/min. In addition, the top-injecting lance was apart from the bath surface by 1.0–2.5 m.

The results of this working example and the comparative example are shown in Table 3. As is apparent from Table 3, in the working examples 5-1 to 5-11 in Table 3, the sulphur concentration after treatment easily reaches the level being less than 10 ppm. On the other hand, as shown in the comparative example 5-2, when the top-injected amount of $O_2$ is changed and the bath depth is changed by moving the ladle up and down, for the injected amount of the powder mainly containing CaO being less than 1 kg/t, there is not generated the remarkably preferable sulphurizing effect. Also, as shown in the comparative examples 5-1 and 5-3, when the bath depth is made constant and $O_2$ is not top-injected, for the injected amount of the powder containing CaO being 1 kg/t or more, the sulphur concentration cannot reach the ultra-low level being less than 10 ppm. This exhibits the predominance of the present invention.

TABLE 3

| | Top-injected amount of $O_2$ ($Nm^3$) | Bath depth (m) | Temperature of molten steel (°C.) Before treatment | Temperature of molten steel (°C.) After treatment | Injected amount of powder (kg) | Composition of powder (%) | sulphur (%) Before treatment | sulphur (%) After treatment |
|---|---|---|---|---|---|---|---|---|
| working example 5-1 | 350 | 0.41 (bath depth: constant) | 1610 | 1580 | 600 | CaO/80, $CaF_2$/20 | 35 | 4 |
| 5-2 | 280 | 0.38 (bath depth: constant) | 1608 | 1590 | 300 | CaO/90, $Al_2O_3$/10 | 32 | 5 |
| 5-3 | 400 | 0.35 (bath depth: constant) | 1620 | 1585 | 700 | CaO/80, $CaF_2$/20 | 38 | 3 |
| 5-4 | 450 | 0.40 (bath depth: constant) | 1615 | 1580 | 700 | $CaF_2$/95, $CaF_2$/5 | 29 | 4 |
| 5-5 | 500 | 0.43 (bath depth: constant) | 1620 | 1580 | 1100 | CaO/100 | 31 | 3 |
| 5-6 | — | 0.21 (bath depth: reduced) | 1625 | 1580 | 600 | CaO/100 | 33 | 4 |
| 5-7 | — | 0.30 (bath depth: reduced) | 1615 | 1580 | 300 | CaO/80, $CaF_2$/20 | 37 | 5 |
| 5-8 | — | 0.16 (bath depth: reduced) | 1630 | 1585 | 1000 | CaO/90, $CaF_2$/10 | 32 | 3 |
| 5-9 | — | 0.13 (bath depth: reduced) | 1620 | 1580 | 400 | CaO/95, $Al_2O_3$/5 | 39 | 5 |
| 5-10 | 300 | 0.26 (bath depth: reduced) | 1610 | 1581 | 500 | CaO/95, $Al_2O_3$/5 | 34 | 3 |
| 5-11 | 280 | 0.21 (bath depth: reduced) | 1605 | 1585 | 350 | CaO/100 | 39 | 4 |
| comparative example 5-1 | — | 0.37 (bath depth: constant) | 1620 | 1580 | 400 | CaO/90, $CaF_2$/10 | 38 | 15 |
| 5-2 | 250 | 0.18 (bath depth: | 1605 | 1580 | 200 | CaO/80, $CaF_2$/20 | 37 | 14 |

TABLE 3-continued

| | Top-injected amount of $O_2$ ($Nm^3$) | Bath depth (m) | Temperature of molten steel (°C.) Before treatment | After treatment | Injected amount of powder (kg) | Composition of powder (%) | sulphur (%) Before treatment | After treatment |
|---|---|---|---|---|---|---|---|---|
| | | reduced) | | | | | | |
| 5-3 | — | 0.36 (bath depth: constant) | 1620 | 1580 | 600 | CaO/80, $CaF_2$/20 | 38 | 16 |

WORKING EXAMPLE 6

The molten steel in an amount of about 270 t was tapped from the converter to the ladle.

For adjusting the slag composition during the tapping, CaO was charged in an amount of 300–500 kg/ch. Then, directly after tapping, 0.7 kg/t of Al powder was added on the ladle slag, to thus reduce FeO and MnO in the ladle slag. After that, CaO was charged in an amount of 300–1000 kg/ch, thus performing the RH vacuum degassing treatment.

The composition of the molten steel was; C: 0.08–0.15 wt %, Si: 0.10–0.20 wt %, Mn: 0.8–1.2 wt %, P: 0.015–0.020 wt %, S: 0.003–0.005 wt %, and Al: 0.03–0.05 wt %.

In the RH vacuum degassing treatment, at the time elapsing 3 min. since starting the treatment, 2 kg/t of the flux was injected together with Ar gas. At this time, the composition of the flux was; CaO: 80 wt %, and CaF2: 20 wt %. The RH vacuum degassing treatment was performed for 20 min.

Figure 14:
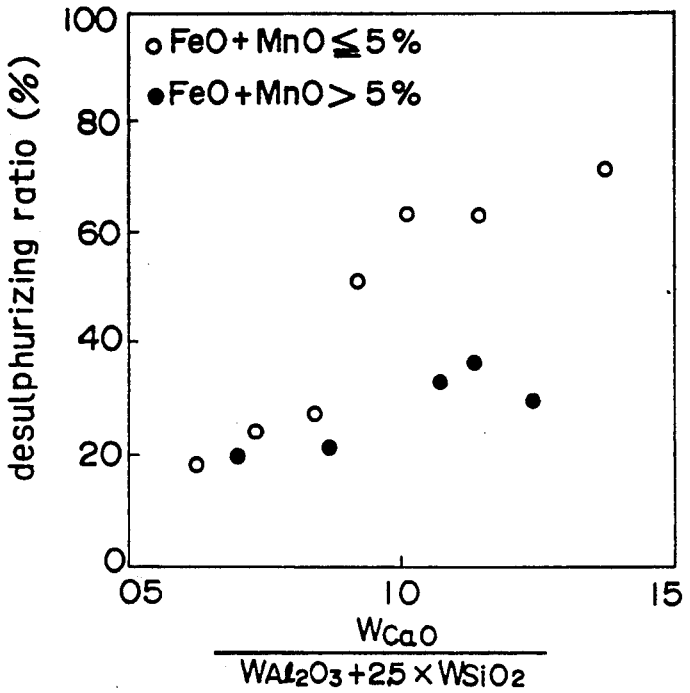
FIG. 14 is a view showing the desulphurizing ratio depending on the change in the slag composition.

The results of the sulphurizing experiment made under the above condition are shown in FIG. 14. In this figure, the abscissa indicates the index calculated by the slag composition and is represented as:

$$W_{CaO}/(W_{Al_2O_3}+2.5\ W_{SiO_2})$$

Also, in this figure, each plot marked as a white circle corresponds to the case of $FeO+MnO \leqq 5\%$, and each plot of a black circle corresponds to the case of $FeO+MnO > 5\%$.

As a result shown in FIG. 14, in the case of $FeO+MnO \leqq 5\%$, the desulphurizing ratio is low irrespective of the slag composition. Also, even in the case of $FeO+MnO > 5\%$, if the equation of $W_{CaO}/(W_{Al_2O_3}+2.5\ W_{SiO_2}) \geqq 9$ is not satisfied, the desulphurizing ratio is low, that is, effective desulphurization is not performed.

As described above, it becomes apparent that the desulphurizing method of the present invention is required to enable the effective desulphurization.

Next, the experiment was repeated, except for changing the unit requirement of the flux. The result is shown in FIG. 15.

Figure 15:
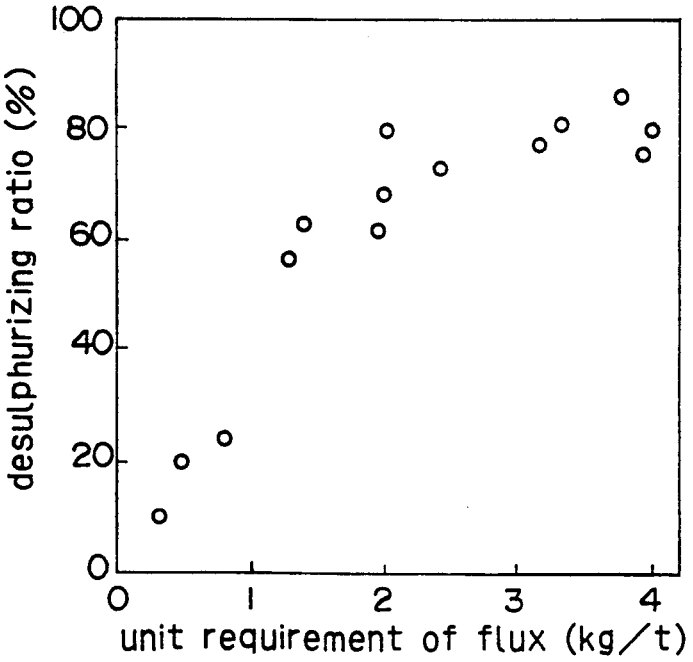
FIG. 15 is a view showing a relationship between the unit requirement of the flux and the desulphurizing ratio.

As is apparent from FIG. 15, for the unit requirement of the flux being 1 kg/t or less, even if the slag composition is suitably adjusted, the desulphurizing ratio is low. The reason for this is that, since the desulphurization is mainly dependent on the injected flux, the unit requirement being 1 kg/t or less seems to be simply too small for effecting the desulphurization.

We claim:

1. A method of refining a high purity steel comprising the steps of:

adding a reducing agent and a flux on a bath surface within a ladle containing molten steel decarburized in a converter, thereby adjusting the composition of slag formed on the bath surface;

setting the ladle in an RH vacuum degassing unit; and blowing a reducing agent and a powder flux with a carrier gas through a lance onto the bath surface within the RH vacuum degassing unit in order to lower effectively impurities in the molten steel to respective ultra-low regions.

2. A method of refining a high purity steel comprising:

(1) a prerefining process of suppressing the contents of P and S contained in molten iron tapped from a blast furnace to be 0.05 wt % or less and 0.01 wt % or less, respectively;

(2) a process of decarburizing the molten iron after said prerefining process in a converter in such a manner that the carbon content is within the range of 0.02–0.1 wt %;

(3) a process of adding a reducing agent and a flux on a bath surface of a ladle containing a molten steel after said decarburizing process, thereby adjusting the composition of slag formed on the bath surface in such a manner that the total concentration of FeO and MnO becomes 5 wt % or less; followed by (4) a process of injecting an oxidizing gas on the bath surface of the molten steel introduced from the ladle to a vacuum vessel of an RH vacuum degassing unit, thereby adjusting the oxygen concentration and the temperature of the molten steel; injecting a powder containing hydrogen for adjusting the carbon concentration of the molten steel in a specified range; and adding a deoxidizing agent within the vacuum vessel for deoxidizing the molten steel.

3. A method of refining a high purity steel using an RH vacuum degassing unit comprising the steps of:

containing molten steel decarburized in a converter in a ladle, and adding a reducing agent on a bath surface of the ladle during or after tapping, thereby forming a slag which is adjusted in such a manner that the total concentration of FeO and MnO becomes 5 wt % or less;

mounting an RH vacuum degassing unit to the ladle, and injecting an oxidizing gas on the bath surface of the molten steel introduced in a vacuum vessel of said RH vacuum degassing unit from a top-injecting lance for at least a part of period of the RH vacuum degassing treatment; and adding Al on the molten steel after the RH vacuum degassing treatment, and subsequently, injecting a powder flux containing 50 wt % or more of CaO in an amount of 3 kg per lt of said molten steel on the bath surface of the molten steel from said top-injecting lancer.

4. A method of refining a high purity steel comprising a process of desulphurizing molten steel in a ladle using an RH vacuum degassing unit including a top-injecting lance, wherein the T·Fe concentration of slag existing on the surface of the molten steel within the ladle is specified to be 10% or less; and a powder flux containing CaO and 5–40 wt % of $CaF_2$ and $Al_2O_3$ is vertically injected on the surface of the molten steel circulating within a vacuum vessel together with a carrier gas at a flow rate of 10 m/sec or more from said top-injecting lance in the amount specified by the following equation:

$$\omega/\rho \geqq 0.015\ A$$

wherein $\omega$ is the weight of the powder containing CaO kg(Kg), $\rho$ is the density (kg/m$^3$) of the powder containing CaO, A is the sectional area (m$^2$) of the ladle at the position of the surface of the molten steel, and the value of 0.015 is a coefficient equivalent to the thickness of a flux layer.

5. A method of refining a high purity steel comprising a process of injecting a powder flux together with a carrier gas on a bath surface of molten steel circulating from a ladle to a vacuum vessel of a RH vacuum gassing unit, thereby desulphurizing the molten steel, wherein the total concentration of FeO and MnO in slag on the molten steel within said ladle is specified to be 5 wt % or less; and the concentration of Al in the molten steel within the ladle is adjusted to 0.02 wt % or more.

6. A method of refining a high purity steel according to claim 4, wherein the injected amount of the flux powder is specified to be 0.2 kg/min per 1 t of the molten steel.

7. A method of refining a high purity steel comprising a process of adjusting the total concentration of FeO and MnO of ladle slag to be 5 wt % or less, and of injecting a gas and a desulphurizing agent on a steel bath surface within a vacuum vessel of a RH vacuum degassing unit from a top-injecting lance provided to the vessel, thereby desulphurizing the molten steel, wherein said method comprises the steps of:

injecting oxygen or an oxidizing gas on the steel bath surface within the vacuum vessel from said top-injecting lance;

adding Al or a reducing agent containing Al; and injecting a powder flux containing CaO from the top-injecting lance in an amount of at least 1 kg/t.

8. A method of refining a high purity steel using a RH vacuum degassing unit comprising a process of adjusting the total concentration of FeO and MnO of ladle slag to be 5 wt % or less, and of injecting a gas and a desulphurizing agent on a steel bath surface within a vacuum vessel of a RH vacuum degassing unit from a top-injecting lancer provided to the vessel, thereby desulphurizing molten steel, wherein said method comprises the steps of:

injecting a powder flux containing CaO from said top-injecting lancer in an amount of at least 1 kg/t; and reducing the bath depth of molten steel remaining within said vacuum vessel;

thereby circulating said injected powder flux between the vacuum vessel and a ladle together with the molten steel.

9. A method of refining a high purity steel using an RH vacuum degassing unit comprising a process of adjusting the total concentration of FeO and MnO of ladle slag to be 5 wt % or less, and injecting a gas and a desulphurizing agent on a steel bath surface within a vacuum vessel of a RH vacuum degassing unit from a top-injecting lancer provided to the vessel, thereby desulphurizing molten steel, wherein said method comprises the steps of:

injecting oxygen or an oxidizing gas on the steel bath surface within the vacuum vessel from said top-injecting lancer;

adding Al or a reducing agent containing Al;

injecting a powder flux containing CaO from the top-injecting lancer in an amount of at least 1 kg/t; and descending the position of a ladle for reducing the bath depth of the molten steel remaining within said vacuum vessel;

thereby circulating said injected powder flux between the vacuum vessel and the ladle together with the molten steel.

10. A method of refining a high purity steel using a RH vacuum degassing unit comprising a process of injecting a powder flux containing CaO together with a carrier gas on a steel bath surface within a vacuum vessel of a RH vacuum degassing unit including a top-injecting lancer from the top-injecting lancer, thereby desulphurizing molten steel, wherein said method comprises the steps of:

adding a reducing agent on molten steel during or after tapping, thereby reforming the composition of ladle slag in such a manner that the total concentration of FeO and MnO contained in the ladle slag is adjusted to be 5 wt % or less;

charging CaO in a ladle during or after tapping, thereby adjusting the composition of ladle slag before RH vacuum degassing treatment to be the value represented as the following equation; and injecting a powder flux containing CaO on the molten steel within the vacuum vessel from said top-injecting lancer in an amount of at least 1.0 kg/t, thereby performing RH vacuum degassing treatment:

$$W_{CaO}/(W_{Al_2O_3}+2.5W_{SiO_2}) \geqq 9$$

wherein $W_{CaO}$ is the content of CaO in slag (wt %), $W_{Al_2O_3}$ is the content of $Al_2O_3$ in slag (wt %), and $W_{SiO_2}$ is the content of $SiO_2$ in slag (wt %).

11. A method of refining a high purity steel comprising a process of desulfurizing molten steel in a ladle using an RH vacuum degassing unit including a top-injecting lance, wherein the T·Fe concentration of slag existing on the surface of the molten steel within the ladle is specified to be 10% or less; and a powder flux containing CaO and 5–40 wt % of $CaF_2$ is vertically injected on the surface of the molten steel circulating within a vacuum vessel together with a carrier gas at a flow rate of 10 m/sec or more from said top-injecting lance in the amount specified by the following equation:

$$\omega/\sigma \geqq 0.015A$$

wherein $\omega$ is the weight of the power containing CaO (kg), $\sigma$ is the density (kg/m$^3$) of the powder containing CaO, A is the sectional area (m$^2$) of the ladle at the position of the surface of the molten steel, and the value of 0.015 is a coefficient equivalent to the thickness of a flux layer.

12. A method of refining a high purity steel comprising a process of desulfurizing molten steel in a ladle using an RH vacuum degassing unit including a top-injecting lance, wherein the T·Fe concentration of slag existing on the surface of the molten steel within the ladle is specified to be 10% or less; and a powder flux containing CaO and 5–40 wt % of $Al_2O_3$ is vertically injected on the surface of the molten steel circulating within a vacuum vessel together with a carrier gas at a flow rate of 10 m/sec or more from said top-injecting lance in the amount specified by the following equation:

$$\omega/\sigma \geqq 0.015A$$

wherein $\omega$ is the weight of the power containing CaO (kg), $\sigma$ is the density ($kg/m^3$) of the powder containing CaO, A is the sectional area ($m^2$) of the ladle at the position of the surface of the molten steel, and the value of 0.015 is a coefficient equivalent to the thickness of a flux layer.

* * * * *

UNITED STATES PATENT AND TRADEMARK OFFICE

CERTIFICATE OF CORRECTION

PATENT NO. : 5,304,231

DATED : April 19, 1994

INVENTOR(S) : Yoshiei Kato et al

It is certified that error appears in the above-indentified patent and that said Letters Patent is hereby corrected as shown below:

Column 13:

In Table 2, at Comparative Example 3-3, under the column "Composition of synthetic flux (%)" after "CaO/70, $Al_2O_3$/20"insert --$CaF_2$/10--

Signed and Sealed this

Twenty-sixth Day of July, 1994

Bruce Lehman

*Attest:*

BRUCE LEHMAN

*Attesting Officer*

*Commissioner of Patents and Trademarks*